US006268319B1

(12) United States Patent
Junga

(10) Patent No.: US 6,268,319 B1
(45) Date of Patent: Jul. 31, 2001

(54) SLIDE WAY LUBRICANT COMPOSITION, METHOD OF MAKING AND METHOD OF USING SAME

(75) Inventor: Anthony G. Junga, Fraser, MI (US)

(73) Assignee: General Oil Company, Livonia, MI (US)

( * ) Notice: Subject to any disclaimer, the term of this patent is extended or adjusted under 35 U.S.C. 154(b) by 0 days.

(21) Appl. No.: 09/462,430

(22) PCT Filed: Jul. 7, 1998

(86) PCT No.: PCT/US98/14112

§ 371 Date: Mar. 28, 2000

§ 102(e) Date: Mar. 28, 2000

(87) PCT Pub. No.: WO99/02627

PCT Pub. Date: Jan. 21, 1999

Related U.S. Application Data

(60) Provisional application No. 60/051,935, filed on Jul. 8, 1997.

(51) Int. Cl.[7] ..... C10M 101/02; C10M 129/74; C10M 129/72

(52) U.S. Cl. ..... 508/493; 508/492; 508/569

(58) Field of Search ..... 508/493, 492, 508/569

(56) References Cited

U.S. PATENT DOCUMENTS

| | | | |
|---|---|---|---|
| 2,614,914 | * | 10/1952 | Eby . |
| 3,216,935 | | 11/1965 | Morway et al. . |
| 3,632,510 | | 1/1972 | LeSuer . |
| 3,729,415 | | 4/1973 | Davis et al. . |
| 3,875,069 | | 4/1975 | Worschech et al. . |
| 3,959,187 | | 5/1976 | Kardol et al. . |
| 3,970,569 | | 7/1976 | Sturwold et al. . |
| 4,031,020 | | 6/1977 | Sugiura et al. . |
| 4,053,428 | | 10/1977 | Pindar et al. . |
| 4,119,553 | | 10/1978 | Cane et al. . |
| 4,175,046 | | 11/1979 | Coant et al. . |
| 4,218,332 | | 8/1980 | Schwab et al. . |
| 4,459,223 | | 7/1984 | Shaub et al. . |
| 4,751,012 | | 6/1988 | Ward et al. . |
| 4,954,572 | | 9/1990 | Emert et al. . |
| 5,185,092 | | 2/1993 | Fukuda et al. . |
| 5,338,471 | | 8/1994 | Lal . |
| 5,358,652 | * | 10/1994 | Macpherson . |
| 5,371,130 | | 12/1994 | Lange et al. . |
| 5,411,672 | | 5/1995 | Kagaya et al. . |
| 5,446,221 | | 8/1995 | Struglinski . |
| 5,453,211 | | 9/1995 | Alward . |
| 5,520,848 | | 5/1996 | Evans . |
| 5,780,399 | * | 7/1998 | Ishikawa et al. ..... 508/452 |
| 5,798,322 | * | 8/1998 | Brannen et al. ..... 508/442 |

OTHER PUBLICATIONS

EEC Classification, Packaging and Labeling of Dangerous Substances Official Journal of the European Communities No L381 "Lubricating Oils (Petroleum), C20–50, hydrotreated neutral oil–based" Dec. 31, 1994.*

* cited by examiner

*Primary Examiner*—Jerry D. Johnson
(74) *Attorney, Agent, or Firm*—Lynn E. Cargill

(57) ABSTRACT

A slide way lubricant composition includes at least (a) a hydrotreated petroleum having a viscosity of from about 10 cSt to about 250 cSt as measured at 40° C. and consisting predominately of hydrocarbons having from about 15 to about 50 carbon atoms per molecule and (b) a polymeric synthetic ester having an average molecular weight of at least about 200,000. The hydrotreated petroleum may be employed in an amount of from about 97.8 to about 99.4 weight percent and the ester may be employed in the composition in an amount of from about 0.6 to about 2.2 weight percent. The ester may be derived from the reaction between a dicarboxylic acid and a polyhydric alcohol. The composition may further include an adhesion additive having an average molecular weight of at least about 1,000,000 and a high pressure agent, such as a trisulfide. A demulsibility agent may also be employed. Another embodiment is a method of making the slide way lubricant composition which includes heating the hydrotreated petroleum to a temperature of from about 90° F. to about 120° F. and blending the polymeric synthetic ester and any other desired components or additives into the heated hydrotreated petroleum. Another embodiment is a method of lubricating a slide way having bearings which includes applying a lubricant composition to the bearings wherein the lubricant composition includes the above described hydrotreated petroleum.

21 Claims, No Drawings

SLIDE WAY LUBRICANT COMPOSITION, METHOD OF MAKING AND METHOD OF USING SAME

This appln is a 371 of PCT/US98/14112 filed Jul. 7, 1998, which claims the benefit of Provisional Application No. 60/051,935 filed Jul. 8, 1997.

BACKGROUND OF THE INVENTION

1. Field of the Invention

The present invention relates generally to lubricant compositions and methods of making and using the lubricant compositions and, more particularly, to slide way lubricant compositions and methods of making and using the same.

2. Description of the Related Art

In industrial manufacturing processes, a way table (or way slide) is commonly used to move a work piece between machining stations. A way table is typically mounted on a carriage having bearing surfaces lubricated with a way lubricant. The carriage moves on slide-ways engaged to the carriage in a parallel fashion on the bearing surfaces. The bearings are also known in the industry as flat bearings, and they include slides, guides, and ways on machine tools.

Metal working operations generally use coolants. As such, the way table is mounted above a coolant reservoir into which the metal working coolants flow. By the very nature of their chemistry, the coolants are capable of dissolving oils. The dissolved oils are mainly way lubricants which are washed off the flat bearings, becoming dissolved into the coolant fluid. Because of their high degree of sulfur and phosphorus content, conventional way lubricants create ideal conditions for bacterial and fungal growth in the coolant, thereby degrading the coolant and creating an environment that can affect the workers safety by causing, e.g., dermatitis and respiratory ailments. Moreover, this creates a condition that contributes to increased waste water and waste oil quantities. There is, therefore, a need for an improved way lubricant which contains less sulfur and phosphorus than conventional way lubricants, while still performing up to industry standards.

Way lubricants preferably exhibit excellent boundary lubrication, possess properties which prevent metal to metal contact even under extreme pressure, and have good adherence to the metallic surfaces while in a flooded condition caused by the continued circulation of the metal working coolant over the lubricant. Due to its chemical nature, the coolant exhibits a cleaning action, thereby washing the lubricant into the coolant reservoir. Not only does the coolant wash the lubricant away from the metallic surfaces, the pressure exerted on the bearing surface by the weight of the way table forces the lubricant away from the bearing surfaces. The reduced level of way lubricant on the bearings creates chatter or stick/slip conditions and reduces machine and tool performance. There is, therefore, a need for an improved way lubricant which has better adherence to the metal surfaces even under high pressures and coolant-flooded conditions.

Therefore, the present invention seeks to provide an improved slide way lubricant which contains less sulfur and phosphorus than conventional way lubricants, while exhibiting a better adherence to the metal surfaces even under high pressures and coolant-flooded conditions. Methods of making and using these improved slide way lubricants are disclosed which are also advantageous.

SUMMARY OF THE INVENTION

In accordance with the present invention, a slide way lubricant composition is disclosed which includes (a) a hydrotreated petroleum having a viscosity of from about 10 cSt to about 250 cSt as measured at 40° C., consisting predominantly of hydrocarbons having from about 15 to about 50 carbon atoms per molecule, in combination with at least (b) a polymeric synthetic ester having an average molecular weight of at least about 200,000. Typically, the hydrotreated petroleum is employed in an amount of from about 97.8 to about 99.4 weight percent, while the ester is employed in the composition in an amount of from about 0.6 to about 2.2 weight percent, the weight percents being based on the total weight of the composition.

Preferably, the ester is derived from the reaction between a dicarboxylic acid and a polyhydric alcohol, and, more preferably, from the reaction between a dicarboxylic acid having from a total of four to eight carbon atoms and a polyhydric alcohol having a total of three to seven carbon atoms.

The lubricant composition may further include one or more other additives, the first being a synthetic polymeric adhesion additive having an average molecular weight of at least about 1,000,000. Furthermore, a sulfurized synthetic high pressure agent, such as a trisulfide may also be added to achieve certain properties. If used, the adhesion additive may be present in an amount of from about 0.1 to about 0.15 weight percent based on the weight of the composition, and the high pressure agent may be present in an amount of from about 0.1 to about 0.6 weight percent based on the weight of the ester.

Another embodiment of the present invention is a method of making the slide way lubricant composition. The method includes heating the hydrotreated petroleum to a temperature of from about 90° F. to about 120° F. and blending into the heated hydrotreated petroleum the polymeric synthetic ester and any other components desired.

Yet another embodiment of the present invention is a method of lubricating a slide way having bearings. This method includes applying a lubricant composition to the bearings wherein the lubricant composition includes a hydrotreated petroleum having a viscosity of from about 10 cSt to about 250 cst as measured at 40° C. and consisting predominantly of hydrocarbons having from about 15 to about 50 carbon atoms per molecule. The hydrotreated petroleum is employed in an amount of from about 97.8 to about 99.4 weight percent based on the weight of the lubricant composition.

Other advantages of the present invention will be readily appreciated as the same becomes better understood after reading the subsequent description.

DESCRIPTION OF THE PREFERRED EMBODIMENT(S)

The present invention discloses a slide way lubricant composition, a method of making a slide way lubricant composition, and a method of using a slide way lubricant composition. The slide way lubricant composition of the present invention contains a) hydrotreated petroleum; and b) at least a polymeric synthetic ester to reduce the coefficient of friction of the composition. The preferred lubricant composition may also contain one or more of the following: c) a high pressure agent; d) an adhesion additive; and e) a demulsibility agent. The lubricant compositions of the present invention also have the advantage that they may be formulated to be free of antioxidants, which are typically phenolic compounds.

I. Composition

A. Hydrotreated Petroleum

The main ingredient, or base oil, of the present lubricant composition is the hydrotreated petroleum. A desirable hydrotreated petroleum will have a viscosity of from about 10 cSt to about 250 cSt as measured at 40° C. and is predominantly a complex combination of hydrocarbons having from about 15 to about 50 carbon atoms per molecule. The preferred viscosity of the hydrotreated petroleum ranges from about 30 to about 220 cSt as measured at 40° C.

Some specific examples of suitable hydrotreated petroleums are defined by industry standard CAS #'s 72623-86-0, 72623-87-1, and 72623-85-9. The petroleum defined by CAS # 72623-86-0 is predominantly a complex combination of hydrocarbons having from 15 to 30 carbon atoms per molecule and has a viscosity of about 15 cSt as measured at 40° C. The petroleum defined by CAS # 72623-87-1 is predominantly a complex combination of hydrocarbons having from 20 to 50 carbon atoms per molecule and has a viscosity of about 32 cSt at 40° C. The petroleum defined by CAS # 72623-85-9 is predominantly a complex combination of hydrocarbons having from 20 to 50 carbon atoms per molecule and has a viscosity of about 112 cSt at 40° C.

The petroleum defined by CAS # 72623-86-0 is prepared by treating widely available light vacuum gas oil and heavy vacuum gas oil with hydrogen in the presence of a catalyst in a two stage process with dewaxing being carried out between the two stages. The petroleums defined by CAS #'s 72623-87-1 and 72623-85-9 are prepared by treating light vacuum gas oil, heavy vacuum gas oil and solvent deasphalted residual oil with hydrogen in the presence of a catalyst in a two stage process with dewaxing being carried out between the two stages. Due to their method of preparation, the hydrotreated petroleums are characteristically low in sulfur content.

The petroleums defined by the CAS #'s discussed above may be used individually or in combination and are especially preferred if the individual petroleums or a combination of the petroleums meet the ISO grades of 32, 46, 68, or 220 (i.e., have a viscosity of 32, 46, 68, or 220 cSt, respectively, at 40° C.).

The hydrotreated petroleum disclosed herein may be purchased from Petrocanada of Mississauga, Ontario; Chevron Chemical Company of San Francisco, Calif.; and/or Conoco Chemicals of Lake Charles, La.; among others.

The hydrotreated petroleum is preferably employed in the lubricant composition in an amount of from about 97.8 to about 99.4 weight percent based on the total weight of the lubricant composition and, more preferably, from about 98.0 to about 98.9 weight percent.

B. Polymeric Synthetic Ester

The polymeric synthetic ester is included in the lubricant composition as a friction modifier to reduce friction, stick, and chatter between the bearing surface and the way table surface. This polymeric synthetic ester has an average molecular weight of greater than at least about 200,000 and may include carboxylic acid esters which include esters of fatty acid dimers and glycols as disclosed in U.S. Pat. No. 4,105,571; the esters of monocarboxylic acids and glycerol as disclosed in U.S. Pat. No. 4,304,678; the esters of dimer acids and monohydric alcohols disclosed in U.S. Pat. No. 4,167,486; the esters of glycerol and monocarboxylic fatty acids as disclosed in U.K. Patent Nos. 2,038,355 and 2,038,356; esters of monocarboxylic fatty acids and polyhydric alcohols disclosed in U.S. Pat. No. 3,933,659; and esters of dicarboxylic acids and polyhydric alcohols some of which are disclosed in U.S. Pat. No. 4,459,233. All of the aforementioned patents relating to esters are incorporated herein by reference.

The preferred type of ester for the lubricant composition is a polymeric ester formed from a dicarboxylic acid and a polyhydric alcohol. Highly desirable esters are derived from reactions between dicarboxylic acids having a total of from four to eight carbon atoms and polyhydric alcohols having a total of from three to seven carbon atoms. The most preferred esters are polymeric esters derived from the reaction between hexanedioic acid and 2,2-bis(hydroxymethyl)-1,3-propanediol and are summarized by CAS # 1 68130-33-6 or CAS # 68130-34-7. It is preferred that the ester have an average molecular weight of at least about 200,000. The ester is preferably used in the lubricant composition at a level of from about 0.6 to about 2.2 weight percent, and more preferably, from about 0.8 to about 1.0 weight percent, based on the weight of the lubricant composition.

C. High Pressure Agent

An optional high pressure agent may be added to the lubricant composition to prevent destructive metal-to-metal contact in lubrication of moving surfaces at high pressures and/or temperatures. Without the high pressure agent, a film of the lubricant composition has a higher tendency to rupture when performing under high pressures and/or temperatures.

Exemplary high pressure agents include sulfurized synthetic compounds, such as sulfurized polyisobutylene, thienyl derivatives, trithiones, disulfides, trisulfides, hydrogen sulfide adducts of olefins, dimethylbenzyl tetrasulfide and tetrasulfide derivatives of $C_{18}$ hydrocarbons, $C_{18}$ fatty acids, and $C_{18}$ fatty acid alkyl and triglyceride esters. Some of these compounds are disclosed in U.S. Pat. Nos. 2,382,700, 2,468,739, 2,479,996, 2,790,775, 3,991,089, 4,000,078, and 4,218,332, which patents are incorporated herein by reference. It is advantageous if the high pressure agent has a molecular weight of at least about 200 to 500 g/mole and a boiling point of at least about 300° C. to insure that it remains in the lubricant composition and is not evaporated during use. A preferred high pressure agent is di-tertiary dodecyl trisulfide.

Preferably, the high pressure agent is employed in an amount ranging from about 0.1 to about 0.06 percent of the weight of the ester employed. If an ester is employed in very small amounts, the high pressure agent may be employed in an amount of from about 0.1 to about 0.6 weight percent, based on the weight of the lubricant composition. If the level of high pressure agent is above or below the preferred level, it is most likely beneficial to also incorporate, at least one of a sulfur scavenger, an anti-oxidant, and/or another type of high pressure agent into the composition.

D. Adhesion Additive

An additional additive, such as a synthetic polymeric adhesion additive, may be employed to help keep the lubricant composition on the bearing surface during operation of the way table. Preferably, a desirable adhesion additive would have an average molecular weight of at least about 1,000,000. A preferred adhesion additive is "ADDCO ADDTAC", available from Gateway Additives of Spartanburg, S.C. If employed, it would be desirable to use the adhesion additive in an amount of from about 0.10 to about 0.15 weight percent, and, more desirably, from about 0.11 to about 0.14 weight percent, based on the weight of the lubricant composition.

E. Demulsibility Agent

A demulsibility agent may be employed in the lubricant composition to improve the lubricant composition's resistance to emulsification. Desirable additives which may be employed as demulsifiers include alkyl benzene sulphonates, polyethylene oxides, polypropylene oxides, salts and esters of oil soluble acids, oxyalkylated trimethylol alkanes, oxyalkylated alkyl phenol-formaldehyde condensation products, tetra-polyoxyalkylene derivatives of ethylene diamine, mixtures of alkylaryl sulfonates, polyoxyalkylene glycols, oxyalkylated alkylphenolic resins, and polyoxyalkylene polyols derived from ethylene oxide, propylene oxide, 1-2, and/or 2-3 butylene oxide, all of which are mentioned in U.S. Pat. Nos. 5,358,652 and 4,751,012, which patents are incorporated herein by reference.

The preferred demulsibility agent is a polyoxyalkylene polyol derived from ethylene oxide, propylene oxide, 1-2, and/or 2-3 butylene oxide. The oxides may be polymerized alone or in combination, and the combined oxides may be polymerized in random or block addition. The optimum level of the polyoxyalkylene polyols in the lubricant composition is from about 50 to about 150 parts per million. A particularly suitable demulsibility agent is "LZ 5172", an ethylene oxide/propylene oxide copolymer available from Lubrizol Corporation of Wickliffe, Ohio.

The lubricant composition of the present invention typically has a viscosity at 100° F. from about 60 to about 80 cSt, more typically, from about 64 to about 78 cSt. The viscosity index of the lubricant composition is at least 95 minutes as measured ASTM D2270-93 test method. The open cup flash point of the lubricant composition is preferably at least about 400° F. The typical thermal stability test acid number of the lubricant composition is at most about 0.30 as measured by ASTM D974-92 test method. The preferred lubricant compositions of the present invention have no precipitate or sludge and result in no stain on a steel rod after Cincinnati Milacron thermal stability test B, result in a "2" rating on a copper rod after the same test, and measure a "1b" rating on the copper corrosion test according to ASTM D-130. The preferred coefficient of friction is 0.74, is the ratio of static to kinetic friction. The method of testing is Cincinnati Milacron's stick-slip test.

II. Method of Making

The lubricant compositions of the present invention are preferably prepared by first heating a desired amount of hydrotreated petroleum in a blending tank to a temperature of from about 90 to about 120° F. It is desirable if the blending tank be equipped with a mixer capable of circulating the contents of the blending tank no less than once every seven minutes. Once the petroleum is heated to the desired temperature, the above described possible additives are preferably added, one at a time, in the above described preferred concentrations, in the following order: first the polymeric synthetic ester, then the high pressure agent, then the synthetic polymeric adhesion additive, and finally the demulsibility agent. Advantageously, the mixture is mixed for at least 15 minutes between the addition of each component.

The following examples are illustrative only and should not be construed as limiting the invention which is properly delineated in the appended claims.

EXAMPLES

A 1000 pound batch of lubricant composition was prepared by blending together, in a blending tank, 98.8225 weight percent hydrotreated petroleum, 0.70 weight percent polymeric synthetic ester, 0.35 weight percent di-tertiary dodecyl trisulfide, 0.12 weight percent "ADDCO ADD-TAC" adhesion additive, and 0.0075 weight percent LZ 5172 demulsibility agent. The blending tank was equipped with a propeller mixer capable of circulating the contents of the blending tank once every seven minutes. The hydrotreated petroleum was first heated to about 1000° F., and, thereafter, the other components were blended into solution in the order listed above. After the addition of each component, the solution was mixed for at least 15 minutes before the addition of the next component. The resulting lubricant composition was tested on a slide way and performed well as a slide way lubricant.

In order to determine this composition's compatibility with coolants, the resulting lubricant composition was tested by adding some of the lubricant composition to two different coolant compositions and comparing test results to coolant compositions without my lubricant composition added. Initially, tanks #1 and #2 only contained a soluble oil coolant at a 5 weight percent concentration. Also, tanks #3 and #4 initially only contained, a semi-synthetic oil coolant at a 5 weight percent concentration. The tanks had a capacity of 5 gallons and were equipped with circulating pumps which were capable of pumping 120 gallons per hour.

On the second day of the tests, I put my new slide-way lubricant into tanks #1 and #3, at a concentration of 4 weight percent of lubricant composition. I did not put any of my lubricant into tanks #2 or #4, in order to give a comparison between plain and adulterated (i.e. with my lubricant) compositions. The pH of the plain and adulterated solutions was taken daily for 14 days and the test results are shown in Table I.

TABLE I

| DAY | TANK #1 | TANK #2 | TANK #3 | TANK #4 |
|---|---|---|---|---|
| 1 | 9.11 | 9.16 | 8.94 | 8.81 |
| 2 | 9.24 | 9.22 | 8.87 | 8.80 |
| 3 | 9.21 | 9.18 | 8.88 | 8.80 |
| 4 | 9.19 | 9.17 | 8.75 | 8.76 |
| 5 | 9.13 | 9.12 | 8.71 | 8.70 |
| 6 | 9.09 | 9.08 | 8.70 | 8.69 |
| 7 | 9.05 | 9.03 | 8.69 | 8.56 |
| 8 | 8.95 | 8.98 | 8.71 | 8.61 |
| 9 | 8.96 | 8.98 | 8.74 | 8.65 |
| 10 | 8.96 | 8.95 | 8.70 | 8.62 |
| 11 | 8.96 | 8.94 | 8.69 | 8.60 |
| 12 | 8.91 | 8.92 | 8.68 | 8.54 |
| 13 | 8.86 | 8.91 | 8.71 | 8.55 |
| 14 | 8.85 | 8.75 | 8.68 | 8.54 |

In order to compare the plain tanks (#2 and #4, with the tanks (#1 and #3) containing my lubricant, please note that a marked increase in pH indicates degradation, which shows detrimental effects of the bistability of the coolant solutions. Note that Tanks #1 and #3 did not show significant increases in pH, while the "plain" tanks (#2 and #4) did exhibit serious degradation. In other words, adding my lubricant to the coolant helped to preserve, keeping it in better working condition.

As another test of my composition, after six days testing, the plain and adulterated coolants from the tanks were tested for their ability to dissipate heat. The results are shown in Table II. The results show that the addition of my lubricant composition to tanks #2 and #4 actually enhanced the ability of the coolants to dissipate heat.

TABLE II

| TANK # | INITIAL °F. | FINAL °F. | DIFFERENCE |
|---|---|---|---|
| 1 | 68° | 131° | 63° |
| 2 | 68° | 164° | 96° |
| 3 | 68° | 167° | 99° |
| 4 | 68° | 172° | 104° |

Looking now to yet another performance criteria, the coefficient of friction of the coolant solutions in the various tanks were also determined relative to direct load and are shown in Table III. The coefficient of friction results show that the solutions from the adulterated tanks usually had lower coefficients of friction than the plain or standard solutions. This phenomena would result in less wear on the machine tools, and is considered a desirable property.

TABLE III

| DIRECT LOAD | TANK #1 | TANK #2 | TANK #3 | TANK #4 |
|---|---|---|---|---|
| 500 | 0.0713 | 0.0832 | 0.0832 | 0.0951 |
| 750 | 0.0634 | 0.0713 | 0.0713 | 0.0872 |
| 1000 | 0.0654 | 0.0743 | 0.0803 | 0.0832 |
| 1250 | 0.0642 | 0.0713 | 0.0809 | 0.0809 |
| 1500 | 0.0674 | 0.0733 | 0.0793 | 0.0813 |
| 1750 | 0.0679 | 0.0713 | 0.0764 | 0.0696 |
| 2000 | 0.0669 | 0.0684 | 0.0773 | 0.0803 |
| 2250 | 0.0661 | 0.0661 | 0.0779 | 0.0779 |
| 2500 | 0.0642 | 0.0618 | 0.0702 | 0.0690 |
| 2750 | 0.0616 | | 0.0605 | |

INDUSTRIAL APPLICABILITY

The industrial applicability of the present invention includes manufacturing facilities where slide ways are used. To use the lubricant composition of the present invention, the lubricant composition is merely applied to the bearings of a slide way.

What is claimed is:

1. A low sulfur, phosphorus free slide way lubricant composition, comprising:

a hydrotreated petroleum having a viscosity of from about 10 cSt to about 250 cSt as measured at 40° C. and consisting predominantly of hydrocarbons having from about 15 to about 50 carbon atoms per molecule, said hydrotreated petroleum being low in sulfur content due to its method of preparation; and a polymeric synthetic ester having an average molecular weight of at least about 200,000, said composition resulting in a low sulfur, phosphorus free slideway lubricant.

2. The composition according to claim 1, wherein the hydrotreated petroleum is employed in an amount of from about 97.8 to about 99.4 weight percent based on the total weight of the composition.

3. The composition according to claim 1, wherein the ester is employed in the composition in an amount of from about 0.6 to about 2.2 weight percent based on the total weight of the composition.

4. The composition according to claim 1, wherein the ester is derived from the reaction between a dicarboxylic acid and a polyhydric alcohol.

5. The composition according to claim 1, wherein the ester is derived from the reaction between a dicarboxylic acid having from a total of four to eight carbon atoms and a polyhydric alcohol having a total of three to seven carbon atoms.

6. The composition according to claim 1, further comprising a high pressure agent in an amount of from about 0.1 to about 0.6 weight percent based upon the weight of the ester.

7. The composition according to claim 6, wherein the high pressure agent is a trisulfide.

8. The composition according to claim 1, further comprising a synthetic polymeric adhesion additive having an average molecular weight of at least about 1,000,000.

9. The composition according to claim 1, further comprising a synthetic polymeric adhesion additive having an average molecular weight of at least about 1,000,000 employed in an amount of from about 0.1 to about 0.15 weight percent based on the total weight of the composition.

10. The composition according to claim 1, further comprising a demulsibility agent.

11. A low sulfur, phosphorus free slide way lubricant composition, comprising:

from about 97.8 to about 99.4 weight percent of a hydrotreated petroleum, said hydrotreated petroleum being low in sulfur content due to its method of preparation, having a viscosity of from about 10 cSt to about 250 cSt as measured at 40° C. and consisting predominantly of hydrocarbons having from about 15 to about 50 carbon atoms per molecule; and from about 0.6 to about 2.2 weight percent of a polymeric synthetic ester having an average molecular weight of at least about 200,000, the weight percents being based on the total weight of the composition, said composition resulting in a low sulfur, phosphorus free slideway lubricant.

12. The composition according to claim 11, wherein the ester is derived from the reaction between a dicarboxylic acid and a polyhydric alcohol.

13. The composition according to claim 11, wherein the ester is derived from the reaction between a dicarboxylic acid having from a total of four to eight carbon atoms and a polyhydric alcohol having a total of three to seven carbon atoms.

14. The composition according to claim 11, further comprising a high pressure agent in an amount of from about 0.1 to about 0.6 weight percent of the weight of the ester.

15. The composition according to claim 14, wherein the high pressure agent is a trisulfide.

16. The composition according to claim 11, further comprising a synthetic polymeric adhesion additive having an average molecular weight of at least about 1,000,000.

17. The composition according to claim 11, further comprising a synthetic polymeric adhesion additive having an average molecular weight of at least about 1,000,000 employed in an amount of from about 0.1 to about 0.15 weight percent based on the total weight of the composition.

18. The composition according to claim 11, further comprising a demulsibility agent.

19. A low sulfur, phosphorus free slide way lubricant composition, comprising:

from about 97.8 to about 99.4 weight percent of a hydrotreated petroleum having a viscosity of from about 10 cSt to about 250 cSt as measured at 40° C. and consisting predominantly of hydrocarbons having from about 15 to about 50 carbon atoms per molecule, said hydrotreated petroleum being low in sulfur content due to its method of preparation;

from about 0.6 to about 2.2 weight percent of a polymeric synthetic ester having an average molecular weight of at least about 200,000, the ester being derived from the reaction between a dicarboxylic acid having a total of four to eight carbon atoms and a polyhydric alcohol having a total of three to seven carbon atoms;

from about 0.1 to about 0.15 weight percent of a synthetic polymeric adhesion additive having an average molecular weight of at least about 1,000,000; and from about 0.1 to about 0.6 weight percent of the weight of the ester of a trisulfide high pressure agent, all weight percents, except for the trisulfide, being based on the total weight of the composition, said composition resulting in a low sulfur, phosphorus free slideway lubricant.

20. A method of making a low sulfur, phosphorus free slide way lubricant composition, comprising heating a hydrotreated petroleum to a temperature of from about 90°

F. to about 120° F., the hydrotreated petroleum having a viscosity of from about 10 cSt to about 250 cSt as measured at 40° C. and consisting predominantly of hydrocarbons having from about 15 to about 50 carbon atoms per molecule; and blending a polymeric synthetic ester having an average molecular weight of at least about 200,000 into the heated hydrotreated petroleum.

21. A method of lubricating a slide way having bearings with a low sulfur, phosphorus free slide way lubricant composition, comprising:

applying a lubricant composition to the bearings, the lubricant composition comprising a hydrotreated petroleum having a viscosity of from about 10 cSt to about 250 cSt as measured at 40° C. and consisting predominantly of hydrocarbons having from about 15 to about 50 carbon atoms per molecule, the hydrotreated petroleum being employed in an amount of from about 97.8 to about 99.4 weight percent based on the weight of the lubricant composition.

* * * * *